United States Patent [19]

Ratliff et al.

[11] Patent Number: 5,023,505

[45] Date of Patent: Jun. 11, 1991

[54] ELECTRIC LAMP WITH IMPROVED FRAME SUPPORT AND METHOD OF PRODUCING SAME

[75] Inventors: Paul A. Ratliff, Hazelwood, Mo.; Robert J. Karlotski, Richmond Hts, Ohio

[73] Assignee: GTE Products Corporation, Danvers, Mass.

[21] Appl. No.: 453,537

[22] Filed: Dec. 20, 1989

[51] Int. Cl.[5] ..... H01J 61/34; H01J 9/34

[52] U.S. Cl. ..... 313/25; 439/927; 445/26; 313/332

[58] Field of Search ..... 313/25, 318, 332, 634; 439/88, 230, 271, 602, 608, 799, 927; 445/26, 29

[56] References Cited

U.S. PATENT DOCUMENTS

| | | | |
|---|---|---|---|
| 2,012,129 | 8/1935 | Hull | 313/261 |
| 2,059,902 | 11/1936 | Persch | 313/271 |
| 2,069,814 | 2/1937 | Bond | 313/271 |
| 2,082,602 | 6/1937 | Steiner | 313/42 |
| 2,132,174 | 10/1989 | Macklett | 313/49 |
| 2,333,052 | 10/1943 | Smith | 313/25 |
| 2,489,939 | 11/1949 | Smith | 60/39.181 |
| 3,229,140 | 1/1966 | Vroom | 313/42 |
| 4,859,899 | 8/1989 | Keeffe et al. | 313/634 |

*Primary Examiner*—Donald J. Yusko
*Assistant Examiner*—Diab Hamadi
*Attorney, Agent, or Firm*—Joseph S. Romanow

[57] ABSTRACT

An electric lamp is provided including a sealed outer glass envelope having an arc tube therein supported from the stem of the outer glass envelope by a support frame. The support frame is attached to the stem by a stem clip to which the support frame is welded. An inert refractory fibrous material is disposed between the stem and the stem clip to provide resiliency and a friction fit therebetween.

32 Claims, 2 Drawing Sheets

ELECTRIC LAMP WITH IMPROVED FRAME SUPPORT AND METHOD OF PRODUCING SAME

BACKGROUND OF THE INVENTION

1. Field of the Invention

The present invention relates to an electric lamp having an outer envelope and an inner envelope, the inner envelope being supported within the outer envelope by a support member which is attached to a stem of the outer envelope, the attachment embodying an improved resilient and friction fit. A method of producing such a lamp is also disclosed.

2. Description of the Prior Art

Hermetically sealed lamps and tubes characteristically include a stem flare which extends into the sealed lamp or tube. Typically, the lead-in conductors are sealed within and extend through the stem flare to provide current to the device in a known manner. The lead-in conductors are attached to various of the components internal of the lamp or tube. It is known to support such components by means of one or more supports which are held in place vis-a vis the stem flare by a metallic band which is clamped to the stem flare. For example, U.S. Pat. No. 2,012,129 to A. W. Hull, which issued on Aug. 20, 1935 relates to a thermionic apparatus wherein the vibratory movement of electrodes is effectively damped by providing a substantially aperiodic support for the members which are subject to vibration. In particular, the support is in the form of a stranded cable or rod comprising parallel lines bound tightly together by a wire wrapped around the parallel wires. The upper end of the support is coupled to the members subject to vibration and the lower end is held in place by means of a sheet metal clamp which clamps the support and fits tightly over and pinches the press.

U.S. Pat. No. 2,059,902 to W. Persch, which issued on Nov. 3, 1936, relates to an electrode mounting for use with an electric discharge device. In this device an enclosing envelope is provided with a stem tube which extends into the device from a press having lead-in conductors sealed therein and extending therethrough into the enclosing envelope. The patent is of particular interest in that two supporting elements provide additional support for an electrode and a block of electron-emissive material, respectively. These two supporting elements are mounted vis-a-vis the stem tube by means of respective clamping rings which fit snugly upon the external surface of the stem tube such that each supporting element is sandwiched between a ring and the stem tube.

U.S. Pat. No. 2,069,814 to D. S. Bond, which issued on Feb. 9, 1937, relates to a gaseous discharge device employing an electron emitting cathode. Generally, the device includes an enclosing vessel having a hollow reentrant stem. It is of interest in that the electrode is supported by a plurality of rods which are welded to the outer surface of a split metallic collar which is clamped about the reentrant stem.

In U.S. Pat. No. 2,082,602 to H. C. Steiner et al., which issued on June 1, 1937, an electrical discharge device is provided which comprises an evacuated envelope which terminates in a press or stem. Within the envelope there are coaxially arranged a cathode structure, an electrostatic control member or grid and an anode. The grid is in the shape of a cylindrical cap which is supported a suitable distance from the cathode structure by diametrically opposed rods which are secured to an outer surface of a band of metal tightly embracing the stem.

U.S. Pat. No. 2,132,174 to R. R. Macklett, which issued on Oct. 4, 1989, relates to an X-ray tube which comprises a cathode which is mounted in the end of a split bushing which fits over the reentrant end portion of a neck of the envelope and is secured thereto by means of a metal sleeve such that the bushing is sandwiched between the reentrant end portion and sleeve.

U.S. Pat. No. 2,333,052 to C. G. Smith, which issued on Oct. 26, 1943, relates to an electrical discharge lamp comprising an evacuated transparent container which is mounted within an evacuated envelope and supported therein by spring arms which are carried by the outer peripheral surface of a clamping ring. The clamping ring is clamped around a reentrant stem.

U.S. Pat. No. 2,489,939 to E. K. Smith, which issued on Nov. 29, 1949, relates to an electron discharge tube which comprises an envelope having a control grid therein which is welded to the upper ends of hairpin supports. The lower ends of the supports are welded to a crimped collar. The grid is thereby supported within the envelope by the crimped collar on a circular mounting stem, the supports extending from the collar to the grid.

U.S. Pat. No. 3,229,140 to W. L. Vroom, which issued on Jan. 11, 1966, relates to an electron discharge tube comprising a conventional cylindrical cathode assembly which is supported in a glass envelope by two stiff bifurcated uprights. Each upright is welded at one end to the cathode assembly and at the other end to the outer surface of a metal collar. The metal collar is crimped tightly on a glass reentrant stem of the envelope to hold the cathode assembly in place.

In all of the foregoing structures, the clip-type mounting means engages a glass stem. It is necessary to sufficiently tighten the clip about the stem to hold the structure in place. However, tightening of the clip might crack the glass. A similar problem exists in providing mounts within electric lamps. In one embodiment which has been produced by the assignee of the present invention, a nickel plated stem clip has been used to support an arc tube mount. In such structure, the arc tube mount is welded to the stem clip, and the stem clip is then wrapped tightly around the body of the stem flare, the ends of the stem clip being welded together on the flat of the stem flare. This particular mounting embodiment has teen used in GTE Sylvania MP400/C/BU metal halide lamps discussed in greater detail herein. In such lamps, it has been difficult to reach a balance between the required degree of tightness of the stem clip about the stem flare, on the one hand, and the prevention of cracking of the glass stem on the other.

It is therefore an objective of the present invention to provide a means for mounting a support frame upon a glass stem in such a manner as to provide the required stability of the mount without damage to the glass stem flare.

It has also desirable to improve the insulative features of the arc tube frame support within the outer envelope of the lamp. In particular, it is desirable to improve the degree to which the arc tube support member is electrically isolated from the circuit of the lamp.

SUMMARY OF THE INVENTION

This invention achieves these and other results described in more detail herein by providing an electric lamp which comprises a sealed outer glass envelope having a pair of electrical conductors sealed into and passing through the outer glass envelope. Means is disposed within the outer glass envelope and electrically connected to a respective conductor of the pair of electrical conductors for converting electrical energy into light. The pair of electrical conductors and the converting means comprise an electrical circuit within the outer glass envelope. A lamp base is mechanically connected to the outer glass envelope and electrically connected to the pair of electrical conductors. A support is disposed within the outer glass envelope for supporting the converting means therein from a stem of the outer glass envelope. The support means is electrically isolated from the electrical circuit and comprises a support member which is held in place relative to the stem at one end of the support member by a stem clip. The support member is disposed between the stem clip and the stem. An inert means is interposed between the stem clip and the stem for providing resiliency and a friction fit between the stem clip and the support member on the one hand, and the stem on the other.

DESCRIPTION OF THE PREFERRED EMBODIMENT

Figure 1:
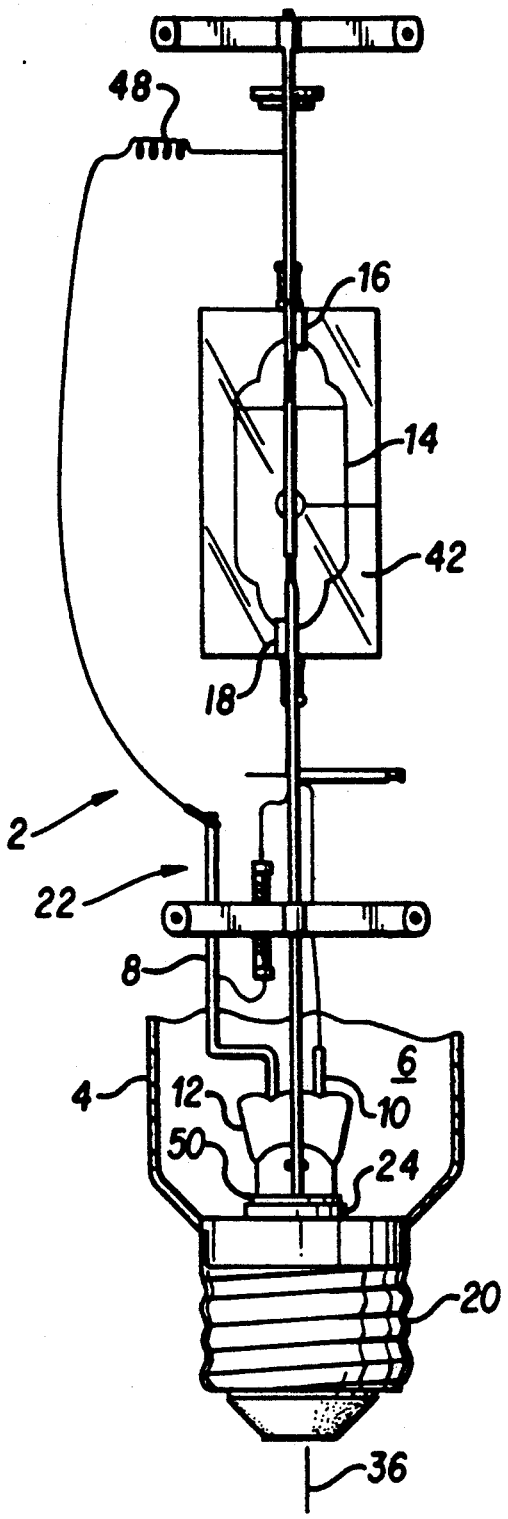
FIG. 1 is a partial cross-sectional view of a electric lamp embodying to present invention.
Figure 2:
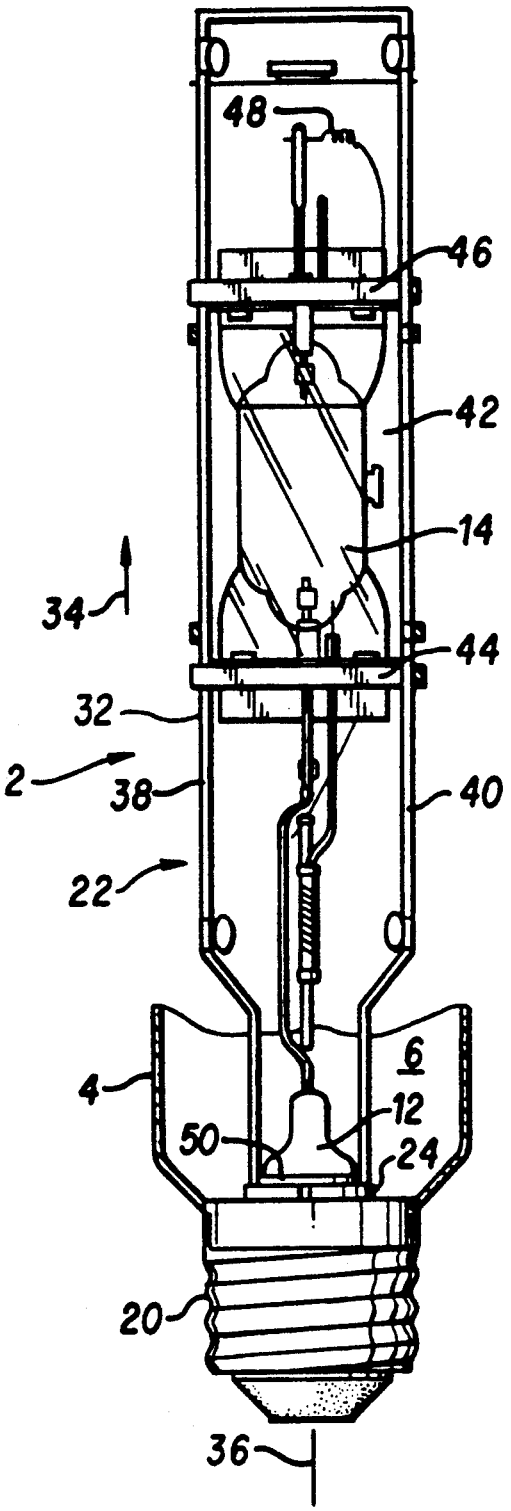
FIG. 2 is a partial cross-sectional view of the lamp of FIG. 1 rotated 90° about its longitudinal axis.
Figure 3:
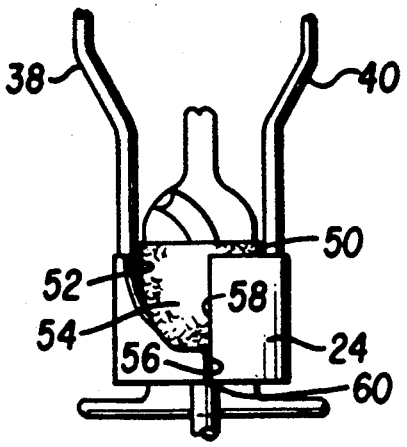
FIG. 3 is an enlarged view of the stem clip arrangement of FIG. 2.

The embodiments of this invention which are illustrated in the drawings are particularly suited for achieving the objects of this invention. FIGS. 1 to 3 depict an electric lamp 2 comprising a hermetically sealed outer glass envelope 4 having a cavity 6 therein. A pair of electrical conductors such as conductors 8 and 10 are sealed into and pass through the stem 12 of the outer glass envelope in a conventional manner. Means is disposed within the cavity 6 of the outer envelope 4 and electrically connected to a respective electrical conductor for converting electrical energy into light. For example, in the preferred embodiment such conversion means is a conventional arc tube 14 having a pair of spaced electrodes 16 and 18 therein with each electrode being electrically connected to a respective electrical conductor of the pair of electrical conductors. In particular, electrode 16 is electrically connected to conductor 8, and electrode 18 is electrically connected to conductor 10 in a conventional manner. In essence, the pair of electrical conductors and the arc tube electrically connected thereto comprise a typical electrical circuit within the cavity 6 of the outer glass envelope 4. The electrical circuit is completed by providing a conventional lamp base 20 which is mechanically connected to the outer glass envelope 4 and electrically connected to the pair of electrical conductors 8 and 10 in a known manner.

A support means is disposed within the outer glass envelope for supporting the converting means wherein from the stem of the outer glass envelope, the support means being electrically isolated from the electrical circuit provided within the outer glass envelope. For example, a support member generally designated 22 is disposed within the cavity 6 of the outer envelope 4 for supporting the arc tube 14 from the stem 12. In particular, the support member 22 is held in place as described hereinafter relative to the stem 12 at one end of the support member by a stem clip 24 such that the support member is disposed between the stem clip 24 and the stem 12. It would be apparent to those skilled in the art that the support member can alternatively be welded on the outer surface of the stem clip. Typically, the support member 22 will include at least one elongated leg 32 which extends in the direction 34 of the longitudinal axis 36 of the lamp 2. In the embodiment depicted in the drawings, the support member includes two elongated legs 38 and 40 which are depicted as being space 180° measured circumferentially relative to a hypothetical cylindrical plane passing through each leg. In the preferred embodiment, legs 38 and 40 are welded to the stem clip 24.

In the embodiment depicted in the drawings, the support member 22 also provides support for a conventional heat shield 42 by means of a first strap member 44 and a second strap member 46. Heat shield 42 is typically a quartz sleeve which can be open at one or both ends. The first and second strap members 44 and 46 are welded to legs 38 and 40 so as to extend therebetween in a direction normal to the longitudinal axis 36. The first and second strap members 44 and 46 are spaced apart from each other along the longitudinal axis 36 by a distance selected according to the length dimensions of the heat shield 42 so as to provide maximum support therefor. The arc tube 14 is positioned within the heat shield 42 in the usual manner.

In a preferred embodiment as depicted in FIGS. 1 and 2, a filament 48 may be included outside of the arc tube 14 and within the outer envelope 4. One known function of a filament 48 within the outer envelope of a metal-halide lamp is to act as an oxidizable fuse link which interrupts the lamp current in the event the outer envelope is fractured in order to prevent possible exposure to ultraviolet light. During lamp operation, the energized filament acts as a source of thermionic electrons. The electrons from the filament provide an additional copious source of electrons within the outer envelope which participate in the known sodium loss phenomenon. Although the present invention is applicable to a lamp with or without such a filament 48, it is believed that the invention herein will be even more efficacious in a lamp employing an energized filament 48 within the outer envelope than in a lamp without such a filament.

An inert means is interposed between the stem clip and the stem for providing resiliency and a friction fit between the stem clip and the support member on the one band and the stem on the other as well as providing greater resistivity in the sodium electrolysis circuit. In the embodiment depicted in the drawings the inert is a refractory fibrous material 50. In the preferred invention the refractory fibrous material is in the form of a silica alumina composition. Examples of silica alumina compositions useful in the present invention include, without limitation, compositions sold under the trademarks FIBERFRAX KAOWOOL and LYTHERM. It will be apparent to those skilled in the art that other inert means can be used in the present invention, and the foregoing examples are by way of example only. For example, other refractory fibrous materials in the form of a refractory oxide can be used.

The inert means preferably has high electrical resistivity so that an additional impedance is interposed in the sodium electrolysis circuit of the lamp. The resistivity of this circuit is already high because of the glass components, for example, the glass stem. At operating temperature, say, 250° C., the glass stem has a slight conductivity which permits a small electrical current, on the order of 0.1 microamperes, to flow in the sodium electrolysis circuit. This miniscule current impacts the rate of sodium migration from the arc tube over the life of the lamp. The additional impedance of the inert means is effective in reducing this small current which in turn reduces sodium loss. Thus, the additional resistance of the inert means enhances the "floating" nature of the lamp frame and heat shield under operating conditions. The floating heat shield and frame are believed to facilitate an accumulation of positive charges on the heat shield and frame which tends to neutralize the thermionic electron flux from the filament.

In the preferred embodiment, each elongated leg 38 and 40 is disposed between an inner surface 52 of the stem clip 24 and outer surface 54 of the inert means 50. In the embodiment depicted in the drawings, the stem clip 24 is in the form of a first sleeve and the inert means is in the form of a second sleeve formed from the refractory fibrous material. The sleeve-like stem clip 24 includes a first end 56 and an opposite second end 58. In assembling the stem clip 24, the refractory fibrous material 50 is wrapped around the stem 12, and the stem clip is firmly wrapped around stem 12 with the sleeve-like refractory fibrous material 50 interposed between the inner surface 52 of stem clip and the outer surface of the stem 12. Upon completion of the wrapping of the stem clip 24, the ends 56 and 58 are welded together at 60.

In order to insure a uniform thickness of the refractory fibrous material 50 about the lamp stem 12, which in turn insures uniformly high resistivity, a preferred method of fabrication is as follows. The refractory fibrous material 50 is obtained in a paper form; that is, in which binders are included. The paper is cut to an appropriate size, such as a rectangle with one side of the rectangle approximately equal to the circumference of the lamp stem and the other side of the rectangle approximately equal to the height of the stem. For a Sylvania MP400 metalarc lamp, this rectangle is 14 mm by 50 mm.

The paper rectangle is fired in air for approximately thirty minutes at about 1,000 degrees celsius in order to decompose and vaporize the binders out of the paper. If the binders are not removed, they might contaminate the atmosphere within the outer envelope of the lamp. This firing process reduces the density of the paper, resulting in a fluffy material with an even higher resistivity than in the paper form because of the greater porosity of the material.

The fibrous material is wrapped about the lamp stem after which the stem clip is securely mounted over the fibrous material such that the stem clip does not make electrical contact with the glass stem.

Modelling calculations indicate that a Sylvania MP400 Metalarc lamp with a Fiberfrax stem insulator will experience reduced sodium loss. The presence of the insulator increases the resistivity of the sodium electrolysis circuit path by approximately one megaohm which translates into an estimated lamp life of at least 20,000 hours, which is considered adequate for a commercially feasible lamp product.

The combination of the stem clip and inert refractory fibrous material of the present invention provides a means to support the support member 22 from the stem 12 having several advantages relative to prior art support means. For example, it is now possible to substantially reduce, if not eliminate, slippage of the support member relative to the stem by merely increasing how tightly the stem clip is wrapped around the stem. Cracking of the stem during this operation is virtually eliminated. To this end, the refractory fibrous material provides a friction fit between the stem and stem clip. Due to its resiliency, the refractory fibrous material also serves to provide some "give" as the stem clip is being tightened around the stem.

A further advantage results from the insulative value of the inert refractory fibrous material. In particular, the refractory fibrous material has a very low conductivity. This is of particular importance regarding what is referred to as an "electrically conductive floating frame" which means that the supportive frame such as the support member 22 is electrically isolated from the circuit of the lamp. As noted above, the support member 22 also supports the beat shield 42 which surrounds the arc tube 14. The "floating-frame" structure is used to control the sodium loss from the arc tube fill by interrupting the electrical circuit between the frame and electrical conductors, arc tube electrodes, and external power source. The "floating-frame" structure provides electrical isolation between the heat shield/arc tube support member and the external circuit, resulting in the frame and shield floating at a positive potential thereby reversing the sodium electrolysis process. The use of the insulative inert refractory fibrous material 50 having relatively low conductivity allows the heat shield 42 to float more easily electrically to thereby increase the resistance to the power leads and minimize sodium loss from the arc tube.

Figure 4:
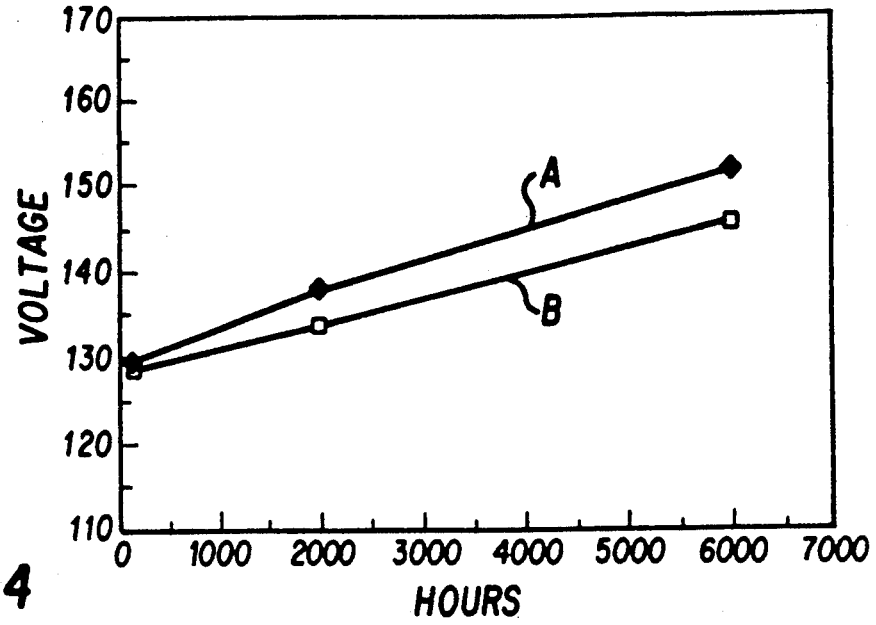
FIG. 4 is a graph plotting voltage rise over lamp life of one embodiment of the present invention relative to a prior art structure.
Figure 5:
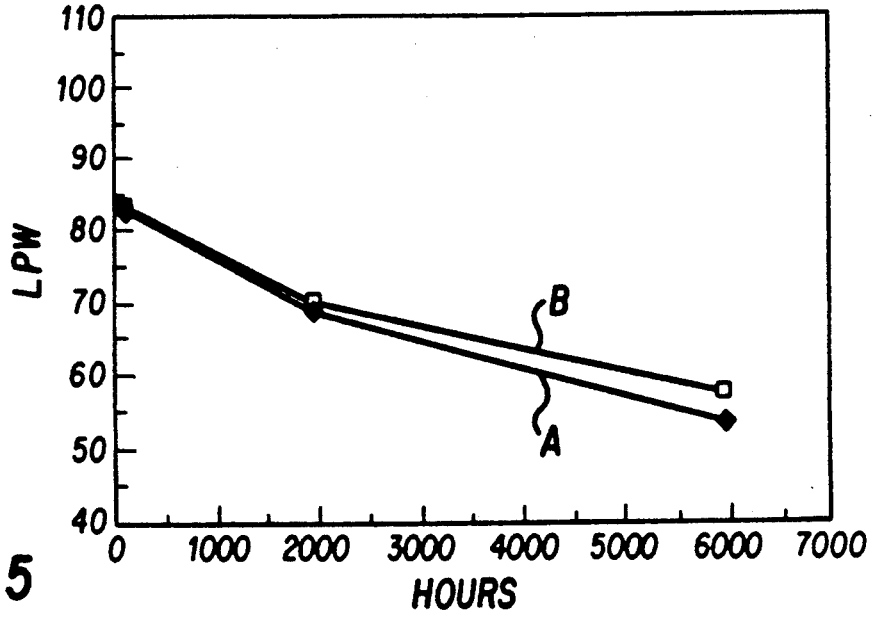
FIG. 5 is a graph plotting lamp efficacy over lamp life of one embodiment of the present invention relative to a prior art structure.

Various advantages of the present invention are evident from the curves depicted in FIGS. 4 and 5. Each of these curves records data obtained from identical 400 watt phosphor coated, base-up open fixture metal halide lamps identified as GTE Sylvania MP400/C/BU lamps with the exception that each "Curve A" represents the average of data recorded using eight lamps wherein a stem clip as described herein is wrapped around the stem of the outer envelope as was conventionally done heretofore without the use of an inert refractory fibrous material, and "curve B" represents the average of data recorded using eight such lamps wherein a stem clip as described herein is wrapped around the stem of an outer envelope with the inert refractory fibrous material sandwiched between the stem clip and the stem as disclosed herein. The three data points indicated in each curve represent average measurements made at intervals of 100, 2000 and 6000 hours. All of the lamps were operated in a conventional base-up (BU) configuration.

The voltage rise is plotted over lamp life, measured in hours, in FIG. 4. It is evident that the voltage rise is less with the inert refractory fibrous material than without such material. The differential in voltage rise should continue to expand with continued use of the lamp.

FIG. 5 shows lamp efficacy over lamp life, measured in hours. It is evident from the curves of FIG. 5 that lumen maintenance is improved when the inert refractory fibrous material is used as described herein.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. An electric lamp, comprising:

a sealed outer glass envelope;

a pair of electrical conductors sealed into and passing through said outer glass envelope;

disposed within said outer glass envelope and electrically connected to a respective electrical conductor of said pair of electrical conductors for converting electrical energy into light, said pair of electrical conductors and said converting means comprising an electrical circuit within said outer glass envelope;

a lamp base mechanically connected to said outer glass envelope and electrically connected to said pair of electrical conductors;

a support means disposed within said outer glass envelope for supporting said converting means therein from a stem of said outer glass envelope, said support means being electrically isolated from said electrical circuit and comprising a support member supported relative to said stem at one end of said support member by a stem clip; and inert means interposed between said stem clip and said stem for providing resiliency and a friction fit between said stem clip and said stem.

2. A lamp as described in claim 1 wherein said support member includes at least one elongated leg.

3. A lamp as described in claim 1 wherein said at least one elongated leg is disposed between said stem clip and said stem.

4. A lamp as described in claim 1 wherein said support member includes at least one elongated leg each leg of said at least one elongated leg being disposed between an inner surface of said stem clip and an outer surface of said inert means.

5. A lamp as described in claim 4 wherein said stem clip is in the form of a first sleeve and said inert means is in the form of a second sleeve.

6. A lamp as described in claim 5 wherein said at least one elongated leg is two elongated legs, said two elongated legs being spaced 180° circumferentially relative to a hypothetical cylindrical plane extending through said two elongated legs.

7. A lamp is described in claim 5 wherein said converting means is an arc tube which includes a pair of spaced electrodes therein with each electrode being electrically connected to a respective electrical conductor of said pair of electrical conductors.

8. A lamp as described in claim 7 wherein said at least one elongated leg is two elongated legs, said two elongated legs being spaced 180° circumferentially relative to a hypothetical cylindrical plane extending through said two elongated legs.

9. A lamp as described in claim 1 wherein said inert means is a refractory fibrous material.

10. A lamp as described in claim 7 wherein said inert means is a refractory fibrous material.

11. A lamp as described in claim 1 wherein said support member is welded to said stem clip.

12. A lamp as described in claim 5 wherein said first sleeve includes a first end and an opposite second end, said first end and said opposite second end being adjacent each other when said stem clip is wrapped around said stem in the form of said first sleeve, said first end being welded to said second end.

13. A lamp as described in claim 12 wherein said support member is welded to said stem clip.

14. A lamp as described in claim 13 wherein said inert means is a refractory fibrous material.

15. A lamp as described in claim 14 wherein said converting means is an arc tube which includes a pair of spaced electrodes therein with each electrode being electrically connected to a respective electrical conductor of said pair of electrical conductors.

16. An electric lamp, comprising:

a sealed outer glass envelope;

a first electrical conductor and a second electrical conductor sealed into and passing through said outer glass envelope;

light means disposed within said outer glass envelope for converting electrical energy into light, said light means including a first lead electrically connected to said first electrical conductor, and a second lead;

filament means disposed within said sealed outer glass envelope for interrupting lamp current if said sealed outer glass envelope is fractured, said filament means including a first end electrically connected to said second electrical conductor and a second end electrically connected to said second lead, said first electrical conductor, said second electrical conductor, said light means and said filament means comprising an electrical circuit within said outer glass envelope;

a lamp base mechanically connected to said outer glass envelope and electrically connected to said first electrical conductor and said second electrical conductor;

a support means disposed within said outer glass envelope for supporting said light means therein from a stem of said outer glass envelope, said support means being electrically isolated from said electrical circuit and comprising a support member held in place relative to said stem at one end of said support member by a stem clip, said support member being disposed between said stem clip and said stem; and inert means interposed between said stem clip and said stem for providing resiliency and a friction fit between said stem clip and said support member on the one hand, and said stem on the other.

17. A lamp as described in claim 16 wherein said support member comprises at least two elongated legs disposed between said stem clip and said stem.

18. A lamp is described in claim 17 wherein each leg of said at least two elongated legs is disposed between an inner surface of said stem clip and an outer surface of said inert means.

19. A lamp as described in claim 18 wherein said stem clip is in the form of a first sleeve and said inert means is in the form of a second sleeve.

20. A lamp as described in claim 19 wherein said light means is an arc tube.

21. A lamp as described in claim 16 wherein said inert means is a refractory fibrous material.

22. A lamp as described in claim 20 wherein said inert means is a refractory fibrous material.

23. A lamp as described in claim 11 wherein said support member is welded to said stem clip.

24. A lamp as described in claim 12 wherein said first sleeve includes a first end and an opposite second end, said first end and said opposite second end being adjacent each other when said stem clip is wrapped around said stem in the form of said first sleeve, said first end being welded to said second end.

25. A method of constructing an electric lamp, said electric lamp comprising a sealed outer glass envelope; a pair of electrical conductors sealed into and passing through said outer glass envelope; means disposed within said outer glass envelope and electrically connected to a respective electrical conductor of said pair of electrical conductors for converting electrical energy into light, said pair of electrical conductors and said converting means comprising an electrical circuit within said outer glass envelope; a lamp base mechanically connected to said outer glass envelope and electrically connected to said pair of electrical conductors; a support means disposed within said outer glass envelope for supporting said light means therein from a stem of said outer glass envelope, said support means being electrically isolated from said electrical circuit and comprising a support member supported relative to said stem at one end of said support member by a stem clip, said method comprising the steps of mounting said support member within said outer glass envelope by:

firing a component which comprises a refractory fibrous material and a binder, provided in paper form, to decompose and vaporize said binder;

wrapping the resulting fibrous material about said stem; and mounting said stem clamp about said stem with said resulting fibrous material sandwiched between said stem clip and said stem such that said stem clip does not make electrical contact with said stem.

26. The method of claim 25 wherein said firing step includes firing said component for about 30 minutes at about 1,000° C.

27. The method of claim 25 wherein said mounting step includes wrapping said stem clip about said stem with said support member being disposed between said stem clip and said stem.

28. The method of claim 25 wherein said refractory fibrous material is a silica alumina composition.

29. A method of constructing an electric lamp, said electric lamp comprising a sealed outer glass envelope; a first electrical conductor and a second electrical conductor sealed into and passing through said outer glass envelope; light means disposed within said outer glass envelope for converting electrical energy into light, said light means including a first lead electrically connected to said first electrical conductor, and a second lead; filament means disposed within said sealed outer glass envelope for interrupting lamp current if said sealed outer glass envelope is fractured, said filament means including a first end electrically connected to said second electrical conductor and a second end electrically connected to said second lead, said first electrical conductor, said second electrical conductor, said light means and said filament means comprising an electrical circuit within said outer glass envelope; a lamp base mechanically connected to said outer glass envelope and electrically connected to said first electrical conductor and said second electrical conductor; a support means disposed within said outer glass envelope for supporting said light means therein from a stem of said outer glass envelope, said support means being electrically isolated from said electrical circuit and comprising a support member supported relative to said stem at one end of said support member by a stem clip, said method comprising the steps of mounting said support member within said outer glass envelope by:

firing a component which comprises refractory fibrous material and a binder, provided in paper form, to decompose and vaporize said binder;

wrapping the resulting fibrous material about said stem; and mounting said stem clamp about said stem with said resulting fibrous material sandwiched between said stem clip and said stem such that said stem clip does not make electrical contact with said stem.

30. The method of claim 29 wherein said firing step includes firing said component for about 30 minutes at about 1,000° C.

31. The method of claim 29 wherein said mounting step includes wrapping said stem clip about said stem with said support member being disposed between said stem clip and said stem.

32. The method of claim 29 wherein said refractory fibrous material is a silica alumina composition.

* * * * *